US006390342B1

(12) United States Patent
Mabee

(10) Patent No.: US 6,390,342 B1
(45) Date of Patent: May 21, 2002

(54) EASY OPENING POUR SPOUT

(75) Inventor: Michael S. Mabee, Mason, OH (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/353,256

(22) Filed: Jul. 14, 1999

Related U.S. Application Data

(60) Provisional application No. 60/092,861, filed on Jul. 15, 1998.

(51) Int. Cl.[7] ..... B65D 47/10
(52) U.S. Cl. ..... 222/541.9
(58) Field of Search ..... 222/153.07, 258, 222/270, 276, 541.9

(56) References Cited

U.S. PATENT DOCUMENTS 5,133,486 A * 7/1992 Moore et al. ..... 222/258
5,735,426 A * 4/1998 Babcock et al. ..... 222/258

* cited by examiner

*Primary Examiner*—Kevin Shaver
*Assistant Examiner*—Thach H. Bui
(74) *Attorney, Agent, or Firm*—Pitts & Brittian, P.C.

(57) ABSTRACT

The present invention discloses and teaches an improved fitment for use on paperboard, gable top liquid containers and the like. More specifically the present invention teaches a easy open tamper evident seal including a pull ring attached to the seal by means of a post having an aspect ratio of less than two thereby requiring less pulling force to break the tamper evident seal and remove it from the fitment spout.

6 Claims, 4 Drawing Sheets

EASY OPENING POUR SPOUT

RELATED APPLICATIONS

This application claims the priority of Provisional Application Ser. No. 60/092,861, filed Jul. 15, 1998 and titled "Easy Opening Spout."

BACKGROUND

The present invention generally relates to an improved pour spout, or fitment, commonly used on paperboard, gable top liquid containers. More particularly, the present invention relates to a linerless fitment having a thin frangible, tamper evident (TE), tear-away seal, integral with the inside the fitment opening.

Tamper evident seals as used on gable top containers typically have a "pull-ring" device attached to the frangible sealing membrane by a connecting post. The consumer pulls on the pull ring to break and remove the seal. A common complaint with such tear-away seals has been directed to the amount of force necessary to initially break and remove the seal. It has been discovered that the force necessary to break and remove the tear-away TE seal is directly dependent upon the geometry and location of the post connecting the pull ring to the TE seal.

By the present invention an improved post geometry has been developed to reduce the force required to break and remove the TE seal or disk from the fitment. An improved pull ring geometry has also been developed to improve grasping the ring. These improvements are considered important for the easy opening feature for consumer convenience.

SUMMARY OF THE INVENTION

It is an object of the present invention to provide an easy opening fitment spout that incorporates an integral tamper evident, ring pull seal that exhibits an opening force of 5 pounds or less to remove the TE seal.

DETAILED DESCRIPTION OF THE PREFERRED EMBODIMENT

Figure 1:
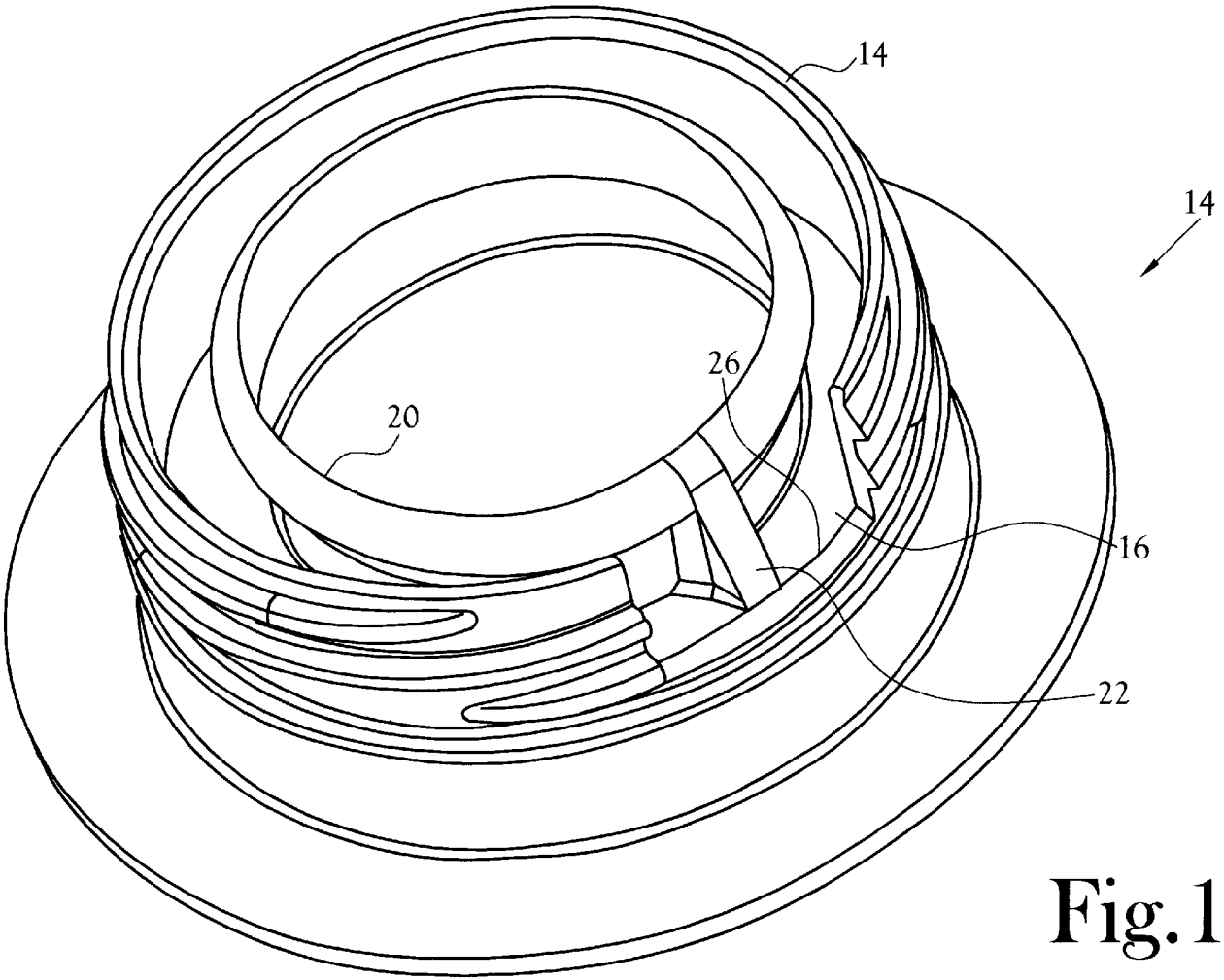
FIG. 1 presents a pictorial view of the spout portion of a fitment assembly embodying the present invention.
Figure 2:
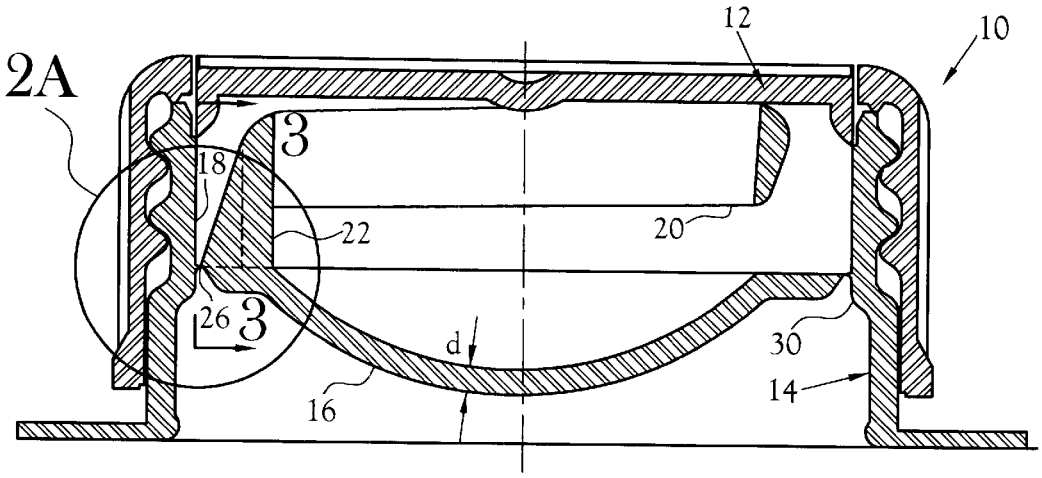
FIG. 2 presents a vertical crossection of a complete fitment assembly embodying the present invention.
Figure 2A:
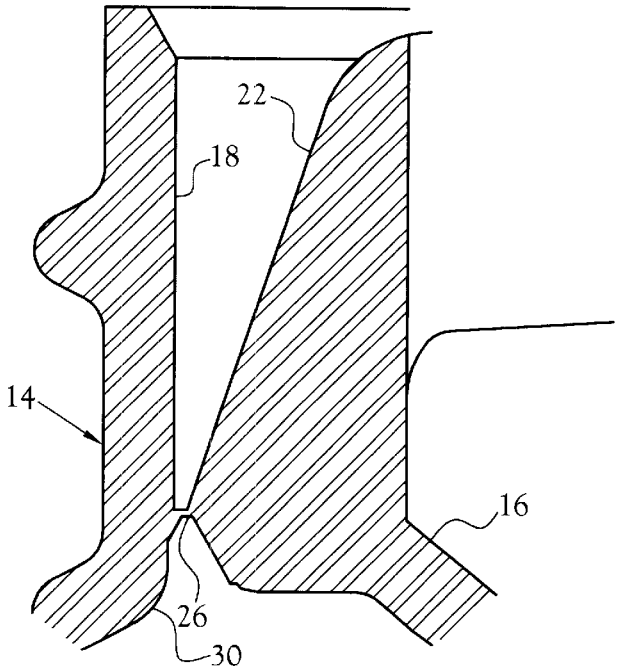
FIG. 2A is an enlarged view of the circled area in FIG. 2.
Figure 3:
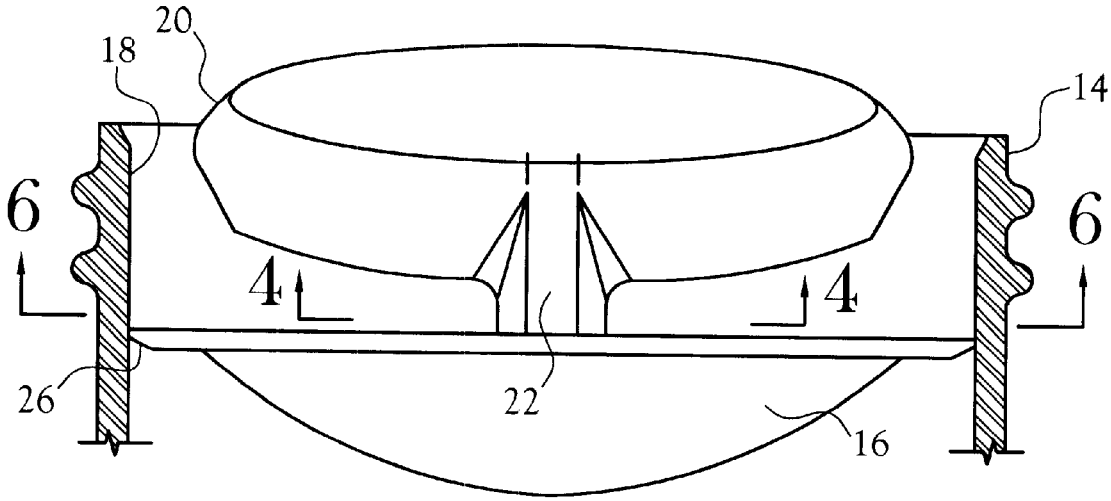
FIG. 3 presents a crossectional view taken along line 3—3 in FIG. 2.

FIGS. 1, 2, and 2A present an improved fitment assembly 10 embodying the present invention. My improved fitment assembly 10 generally comprises 2 basic components; an injection molded, linerless closure 12, and an injection molded spout 14 with an integrated TE liner molded into the spout opening 18. The integrated TE liner comprises a disk 16 molded to the inner spout wall 18, and a pull ring 20 that is attached to disk 16 by means of an integral, upward extending post 22. The circumference of the disk 16 at the attachment point to the inner wall 18 of spout 14 is molded into a thin, annular, sealing membrane 26 that is designed to tear away, when ring 20 is pulled, resulting in removal of the TE disk 16 when spout 14 is initially opened for use.

Figure 4:
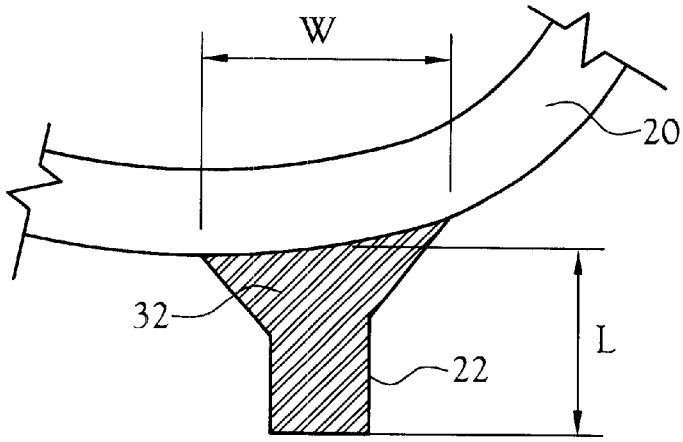
FIG. 4 presents a crossectional view taken along line 4—4 in FIG. 3.
Figure 5:
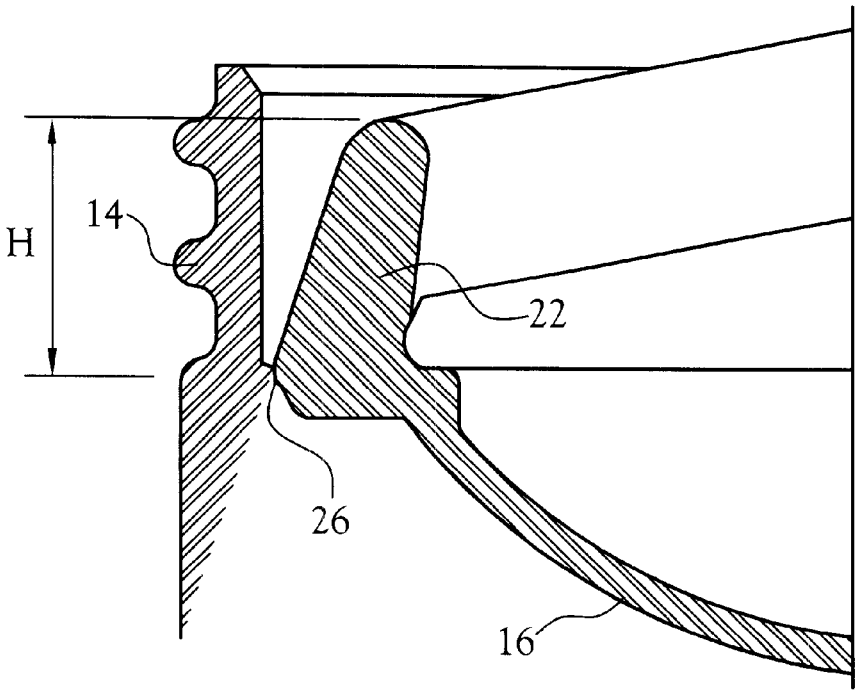
FIG. 5 presents a crossectional view taken along line 5—5 in FIG. 6.

The force necessary to break and remove TE disk 16 is dependent upon several factors such as; the composition of the plastic resin, the thickness of annular sealing membrane 26, the size, configuration and "aspect ratio" of post 22, the location of the post attachment relative to the annular sealing membrane 26, and the rigidity of the spout wall. The "aspect ratio" of post 22, as used herein, is defined as the width w divided by the length l (see FIG. 4).

Typically, in this type of pull ring spout application, low density polyethylene (LDPE) is used because of the relative ease of disk removal although other materials can be used as will be evident from the ensuing discussion.

In addition to material selection, the thickness of the annular tear away sealing membrane 26 can influence the ease of opening of the TE disk 16. The range of membrane thickness is restricted by the practical limits imposed by the injection molding process as well as the force to open. A TE membrane that is too thin, for example, may have material missing from the membrane area when molded or may fail during removal of the spout 10 from the injection mold during manufacture. Conversely, a sealing membrane that is too thick would require excessive force to break and remove it from the spout during initial opening by the consumer. A typical membrane thickness currently in commercial use lies within the range of 0.006" to 0.013".

The cross sectional area of the post 22 at the attachment to the disk 16 as well as the orientation and distance of the post attachment from the sealing membrane 26 can each influence the ease of disk removal for any given sealing membrane thickness. By focusing the pulling force at the sealing membrane 26 via an attachment or post with a small cross sectional area in close proximity to the sealing membrane, removal forces can be reduced significantly. As is the case with sealing membrane thickness, there is a practical limit to the smallest attachment post cross sectional area in order to eliminate the risk of attachment or post failure upon opening and removal of the TE disk.

I have discovered that for any given post attachment cross sectional area 32, the aspect ratio of width w and length l is directly related to the force necessary to initially break and start the tearing off sealing membrane 26, when removing the TE disk 16. I have also discovered that a narrow attachment dimension x, tangent to sealing membrane 26 requires less force to initiate tearing of the sealing membrane than one which has a larger dimension x.

The proximity of post 22's attachment area to sealing membrane 26 also influences the pulling force necessary to initiate tearing of membrane. The closer the post attachment to sealing membrane 26, the less force required to remove TE disk 16. The attachment area should be as close as possible but not interfere with removal of the assembly from the injection mold or it will result in removal related membrane failure prior to use.

The location of the membrane 26 attachment on the inner spout wall 18 of the spout 14 can also influence the force necessary to break and tear TE membrane 26. Babcock et al. (U.S. Pat. No. 5,735,426) teaches that the membrane location should be located on an intermediate shoulder portion 30 of the spout inside wall in order not to reduce the effective cross sectional area of the spout. Locating the membrane above the transitional shoulder area 30, as is the case in the present invention, takes advantage of the spout wall flexibility and results in an easier opening force without significantly reducing the effective opening area of the spout. In addition, there is a material savings associated with reducing the height h of attachment post 22 that results from moving the sealing membrane attachment to the spout inside wall 18 and thereby closer to the top of the spout.

Figure 6:
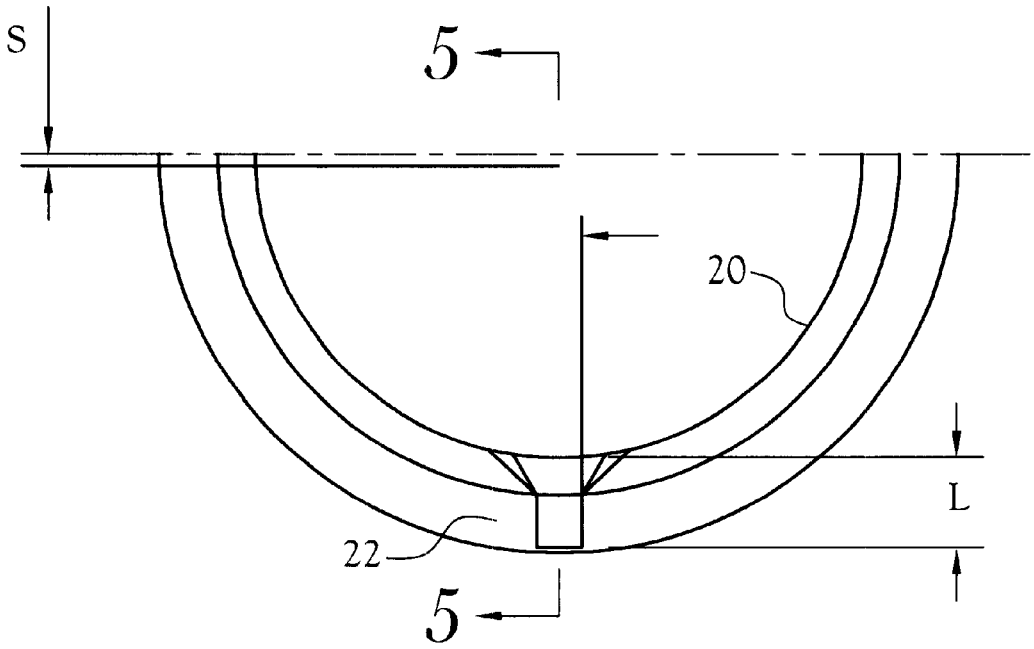
FIG. 6 presents partial bottom view looking upward along line 6—6 in FIG. 3.

Pull ring handle 20 (as illustrated in FIG. 6) is preferably offset by a convenient dimension S, approximately 0.010 inches for a nominal one inch diameter spout, thereby making it more easy to grasp pull ring 20 and avoids the difficulties associated with raising the pull ring up to open without the interference of the inside spout wall 18. A pull ring which is concentric to TE disk 16, and large enough to accommodate a large finger size, will contact the inside spout wall 18 when attempting to grasp the ring to open. This generally results in the finger slipping out of the ring and makes opening less convenient.

Experimental testing has indicated that a fitment having a post attachment cross section area 32 of 0.007 to 0.010 sq. in., and having a sealing membrane thickness 26 of 0.03 in to 0.07 in., and having an post aspect ratio w/l of less than 2, and having the attachment post 22 in close proximity to the TE disk membrane 26 requires less pulling force, upon pull ring 20 to remove the integrated TE disk 16 from the spout without compromising the TE feature.

Table A describes the relationship of the pull ring attachment dimension, aspect ratio, proximity to the tear away membrane seal, and membrane seal thickness to the force required to open three prior art fitments and the present improved fitment. As seen in Table A, the force required to break and remove the sealing membrane is 5.4 pounds as opposed to the nearest prior art fitment which requires 6.5 pounds of force, a reduction of twenty percent. However, as it is also shown in Table A, the force required to break the post is a substantial 9.5 pounds or 75 percent higher than the required membrane breaking force as opposed to 70 percent for the nearest performing prior art system identified as Sample C.

Having described the preferred embodiments of the present invention, and its benefits and advantages, it will be understood by those of ordinary skill in the art that the foregoing description is merely for the purpose of illustration and that numerous substitutions, rearrangements, and modifications may be made in the invention without departing from the scope and spirit of the appended claims.

TABLE A

SUMMARY OF TAMPER EVIDENT PULL RING ATTACHMENT DIMENSIONS AS RELATED TO OPENING FORCE

| Identification | Attachment Area (sq. in.) | Dimensional Aspect Ratio w/l | Thickness of Membrane (in.) | Distance From Post To Centerline Of Membrane (in.) | Average Force To Open (lb) | Average Force To Break Post (lb) |
|---|---|---|---|---|---|---|
| Sample A | 0.02799 | 0.71 | 0.013 | 0.007 | 9.1 | 14.3 |
| Sample B | 0.01109 | 3.11 | 0.009 | 0.02 | 8.4 | 13.8 |
| Sample C | 0.01497 | 3.22 | 0.006 | 0.08 | 6.5 | 11.1 |
| IMPROVED | 0.00813 | 1.10 | 0.006 nom | 0 | 5.4 | 9.5 |

I claim:

1. A pour spout having a tamper evident sealing membrane therein and a pull ring attached to said membrane by a post extending therebetween, said post having a cross-section defining a width at a rearward face disposed toward a center of said membrane and a length defined substantially radially with respect to said membrane, said post further having an aspect ratio defined as said width divided by said length, said aspect ratio being less than two, said post being tapered from said rearward face to a central rib terminating proximate a perimeter of said membrane, said central rib defining an attachment dimension less than said width and said length.

2. The pour spout as claimed in claim 1 wherein said post has an aspect ratio within the range of one to two.

3. The pour spout as claimed in claim 1 wherein said post has a crossectional area within the range of 0.007 to 0.010 square inches.

4. The pour spout as claimed in claim 1 wherein said sealing membrane has a thickness within the range of 0.03 to 0.07 inches.

5. The pour spout as claimed in claim 1 wherein said pull ring is eccentric to said sealing membrane.

6. In a pour spout having a tamper evident sealing membrane therein and a circular pull ring, for removal of said sealing membrane, said pull ring attached to said membrane by a post extending therebetween, the improvement wherein said pull ring is eccentric to said sealing membrane by a factor of about 1/100th of the diameter of said sealing membrane and wherein said post defines a cross-section defining a width at a rearward face disposed toward a center of said membrane and a length defined substantially radially with respect to said membrane, said post further having an aspect ratio defined as said width divided by said length, said aspect ratio being less than two, said post being tapered from said rearward face to a central rib terminating proximate a perimeter of said membrane, said central rib defining an attachment dimension less than said width and said length.

* * * * *